US009422795B2

(12) United States Patent
Kriesels et al.

(10) Patent No.: US 9,422,795 B2
(45) Date of Patent: Aug. 23, 2016

(54) METHOD AND SYSTEM FOR RADIALLY EXPANDING A TUBULAR ELEMENT IN A WELLBORE

(75) Inventors: Petrus Cornelis Kriesels, Rijswijk (NL); Francesco Dalla Longa, Rijswijk (NL)

(73) Assignee: Shell Oil Company, Houston, TX (US)

( * ) Notice: Subject to any disclaimer, the term of this patent is extended or adjusted under 35 U.S.C. 154(b) by 279 days.

(21) Appl. No.: 14/127,273

(22) PCT Filed: Jun. 29, 2012

(86) PCT No.: PCT/EP2012/062677

§ 371 (c)(1),
(2), (4) Date: Dec. 18, 2013

(87) PCT Pub. No.: WO2013/004610

PCT Pub. Date: Jan. 10, 2013

(65) Prior Publication Data

US 2014/0131053 A1 May 15, 2014

(30) Foreign Application Priority Data

Jul. 7, 2011 (EP) ..... 11173007

(51) Int. Cl.
*E21B 7/20* (2006.01)
*E21B 43/10* (2006.01)

(52) U.S. Cl.
CPC ..... *E21B 43/103* (2013.01); *E21B 7/20* (2013.01)

(58) Field of Classification Search
CPC .... E21B 29/002; E21B 29/10; E21B 43/103; E21B 7/20
See application file for complete search history.

(56) References Cited

U.S. PATENT DOCUMENTS

| | | | | |
|---|---|---|---|---|
| 4,431,069 | A | 2/1984 | Dickinson et al. | |
| 6,109,828 | A | 8/2000 | Keller | |
| 6,446,670 | B1 | 9/2002 | Woodward et al. | |
| 7,150,328 | B2 | 12/2006 | Marketz et al. | |
| 7,464,774 | B2 | 12/2008 | Savignat et al. | |
| 7,946,349 | B2 | 5/2011 | Kriesels | |
| 2002/0134270 | A1* | 9/2002 | Patterson | F42B 3/00 102/314 |
| 2004/0216894 | A1* | 11/2004 | Maguire | E21B 43/103 166/384 |
| 2006/0130922 | A1* | 6/2006 | Kamiyama | F16L 55/1651 138/98 |
| 2009/0211765 | A1 | 8/2009 | Keller | |
| 2009/0288842 | A1* | 11/2009 | Kriesels | E21B 43/103 166/384 |
| 2010/0200248 | A1 | 8/2010 | Kriesels et al. | |
| 2010/0270036 | A1 | 10/2010 | Kriesels | |
| 2010/0270037 | A1 | 10/2010 | Kriesels et al. | |
| 2010/0294487 | A1 | 11/2010 | Kriesels | |
| 2010/0294513 | A1 | 11/2010 | Van Nieuwkoop | |

FOREIGN PATENT DOCUMENTS

| | | |
|---|---|---|
| CN | 1630767 | 5/2007 |
| CN | 101910554 A | 12/2010 |
| EP | 2041393 A1 | 1/2008 |
| EP | 2209966 B1 | 5/2011 |

(Continued)

OTHER PUBLICATIONS

PCT International Search Report, Application No. PCT/EP2012/062677 dated Sep. 5, 2012.

*Primary Examiner* — Cathleen Hutchins

(57) ABSTRACT

The invention provides a method and system for radially expanding a tubular element below a previous tubular element.

13 Claims, 5 Drawing Sheets

(56) References Cited

FOREIGN PATENT DOCUMENTS

Figure 1:
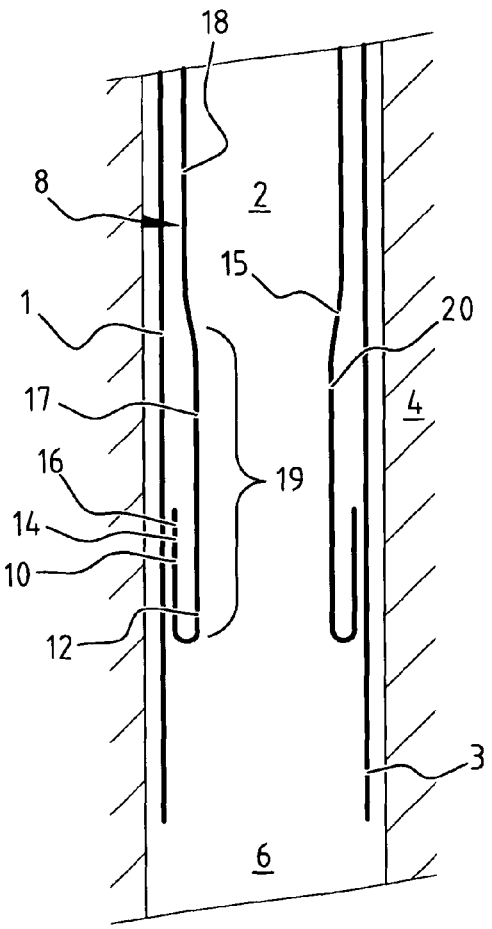

| | | | |
|---|---|---|---|
| EP | 2460972 | A1 | 6/2012 |
| GB | 2456699 | A | 7/2009 |
| GB | 2467242 | A | 7/2010 |
| GB | 2469399 | B | 11/2011 |
| GB | 2469396 | B | 1/2012 |
| GB | 2468416 | B | 2/2012 |
| GB | 2467866 | B | 3/2012 |
| GB | 2468230 | B | 4/2012 |
| GB | 2469213 | B | 1/2013 |
| WO | 2008006841 | A1 | 1/2008 |
| WO | 2008049826 | A1 | 5/2008 |
| WO | 2008061969 | A1 | 5/2008 |
| WO | 2009074633 | A2 | 6/2009 |
| WO | 2012059574 | A1 | 5/2012 |
| WO | 2012059578 | A1 | 5/2012 |

* cited by examiner

METHOD AND SYSTEM FOR RADIALLY EXPANDING A TUBULAR ELEMENT IN A WELLBORE

PRIORITY CLAIM

The present application which is a 371 application of PCT/EP2012/062677, filed Jun. 29, 2012, claims priority from European Application EP 11173007.3, filed Jul. 7, 2011.

The present invention relates to a method of radially expanding a tubular element below a previous tubular element in a wellbore.

The technology of radially expanding tubular elements in wellbores is increasingly applied in the industry of oil and gas production from subterranean formations. Wellbores are generally provided with one or more casings or liners to provide stability to the wellbore wall and/or to provide zonal isolation between different earth formation layers. The terms "casing" and "liner" refer to tubular elements for supporting and stabilising the wellbore wall. Generally, a casing extends from surface into the wellbore and a liner extends from a downhole location further into the wellbore. However, in the present context, the terms "casing" and "liner" are used interchangeably and without such intended distinction.

In conventional wellbore construction, several casings are set at different depth intervals and in a nested arrangement. Each subsequent casing is lowered through the previous casing and therefore has a smaller diameter than the previous casing. As a result, the cross-sectional wellbore size that is available for oil and gas production, decreases with depth. To alleviate this drawback, it is possible to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. Thus the available diameter of the wellbore remains substantially constant along (a portion of) its depth as opposed to the conventional nested arrangement.

WO-2008006841-A1 discloses a method of radially expanding a tubular element extending into a wellbore formed in an earth formation, the method comprising inducing the wall of the tubular element to bend radially outward and in axially reverse direction so as to form an expanded tubular section extending around a remaining tubular section of the tubular element, wherein said bending occurs in a bending zone of the tubular element, the method further comprising increasing the length of the expanded tubular section by inducing the bending zone to move in axial direction relative to the remaining tubular section, and wherein said wall includes a material that is plastically deformed in the bending zone during the bending process so that the expanded tubular section retains an expanded shape as a result of said plastic deformation.

The method disclosed in WO-2008006841-A1 has been found to work well. However, a problem may arise if a previous tubular element has been radially expanded according to the method of WO-2008006841-A1, whereby a downhole end of said previous tubular element has been damaged, for instance due to a failure during the expansion process.

When the pipe fails there is often good reason to want to re-start the expansion process providing an expanded pipe having the same size, i.e. the same outer diameter after expansion. First of all, one will also retain the same inner diameter, which may be desirable to reach a predetermined depth, as for instance set out above. However, an inverted part made from the original pipe will not fit into the well, as the outer diameter thereof will be equal to the outer diameter of the inverted tubular section in the wellbore.

When using the method of WO-2008006841-A1, changing the diameter of the expanded pipe, i.e. to fit within the previously expanded pipe, would require to change the diameter of the unexpanded pipe as well. The unexpanded pipe bends in a predetermined way, based on several factors including its diameter. And changing the diameter of the unexpanded pipe would require changes at surface, which would render the process more expensive or may be impractical. Said changes may include changes to surface equipment. For instance, if the unexpanded section is fabricated on the site of the wellbore using a pipe-mill, said pipe-mill would need to be adapted when changing the diameter of the pipe. In view of strict requirements, including safety requirements and leak-tightness requirements of the expanded pipe section, said pipe-mill is an exceptional piece of equipment which is purpose-build and optimized for a predetermined diameter of the unexpanded pipe section. Alternatively, the unexpanded tubular section may be constructed at surface by adding consecutive pipe sections to the uphole end thereof. Said pipe section have a predetermined outer diameter. When drilling a wellbore, a supply of said pipe sections will have been provided which is sufficient to line the whole wellbore. A change in diameter implies that said supply would have to be replaced with new pipe sections, each having the smaller diameter. The latter would be greatly time and cost consuming at any well site, and even more so when the well is drilled at a remote location.

It is an object of the present invention to provide a method of radially expanding a tubular element below a previous tubular element arranged in a wellbore.

The present invention provides a method of radially expanding a tubular element below a previous tubular element, including the steps of:

- connecting a downhole section to an uphole section of the tubular element, the downhole section having a smaller diameter than the uphole section;
- bending a downhole end of the downhole section radially outward and in axially reverse direction to form a start expanded tubular section extending around an unexpanded part of the downhole section;
- arranging said start expanded tubular section at least partially within a downhole end of the previous tubular element;
- anchoring said start expanded tubular section to the previous tubular element; and
- increasing the length of an expanded tubular section of the tubular element by pushing an unexpanded tubular section downhole relative to said start expanded tubular section to expand the unexpanded tubular section by bending the wall of the unexpanded tubular section radially outward and in axially reverse direction.

Thus the start expanded tubular section at least partially overlaps the previous tubular element. The tubular element may be radially expanded below the previous tubular element to a desired larger outer diameter, for example to an outer diameter which is substantially equal to an inner diameter of the wellbore.

The process of radial expansion by progressively bending the wall of the unexpanded tubular section radially outward and in axially reverse direction to form the expanded tubular section may be referred to hereinafter as "eversion".

The selected diameter of the unexpanded tubular section may cause the unexpanded tubular section to expand below the previous tubular element to an outer diameter which is substantially equal to an outer diameter of the previous tubular element.

Eversion of the unexpanded tubular section is suitably achieved by moving the unexpanded tubular section axially downward relative to the previous tubular element to expand said downhole portion of the unexpanded tubular section by bending of the wall thereof radially outward and in axially reverse direction.

In an embodiment, the method comprises radially expanding said downhole section to radially expand an upper part of the expanded tubular section against the inner surface of the previous tubular element.

Suitably the upper part of the expanded tubular section is provided with anchoring means for anchoring said upper part to the inner surface of the previous tubular element.

To adequately expand the expanded tubular section with the expander, a layer of filler material may be inserted into an annular space between the expanded tubular section and said downhole portion of the unexpanded tubular section. The filler material may be adapted to transfer an expansion force between the expanded tubular section and said downhole portion of the unexpanded tubular section during radial expansion.

Adequate sealing can for instance be achieved by providing said upper part of the expanded tubular section with sealing means for sealing said upper part relative to the previous tubular element.

The method may further comprise removing a damaged downhole end portion of the previous tubular element. Removing said damaged end portion may include cutting or milling the previous tubular element.

Downhole movement of the unexpanded tubular section is adequately achieved by pushing the unexpanded tubular section into the expanded tubular section. Said pushing may at least partly include a gravitational force due to the weight of the unexpanded tubular section.

Figure 2:
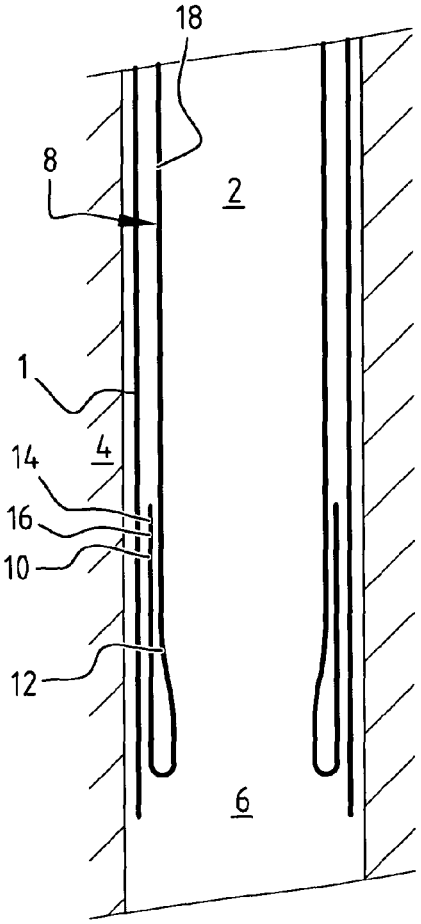
Figure 3:
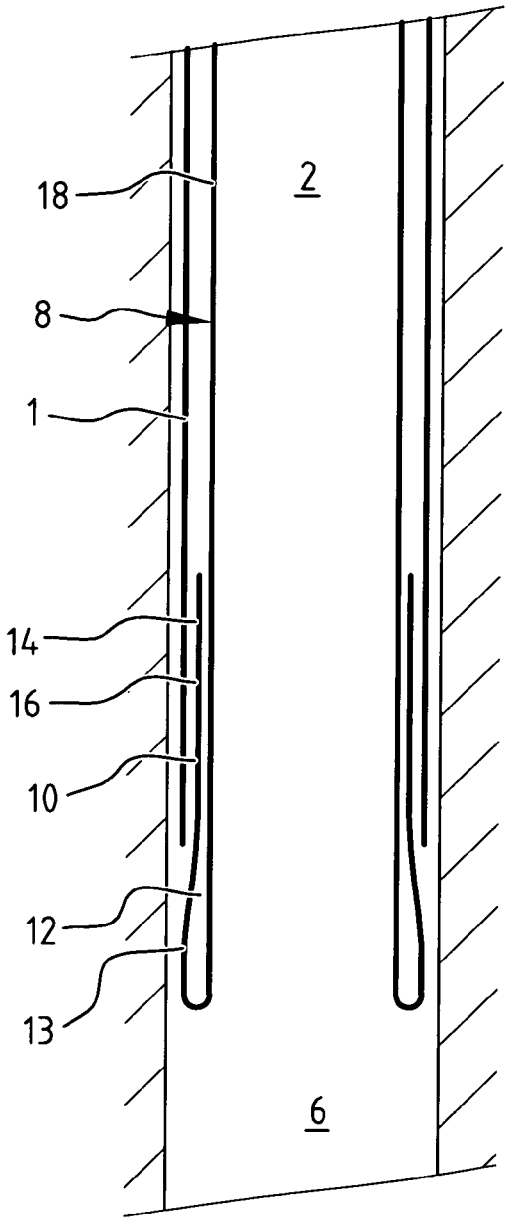
Figure 4:
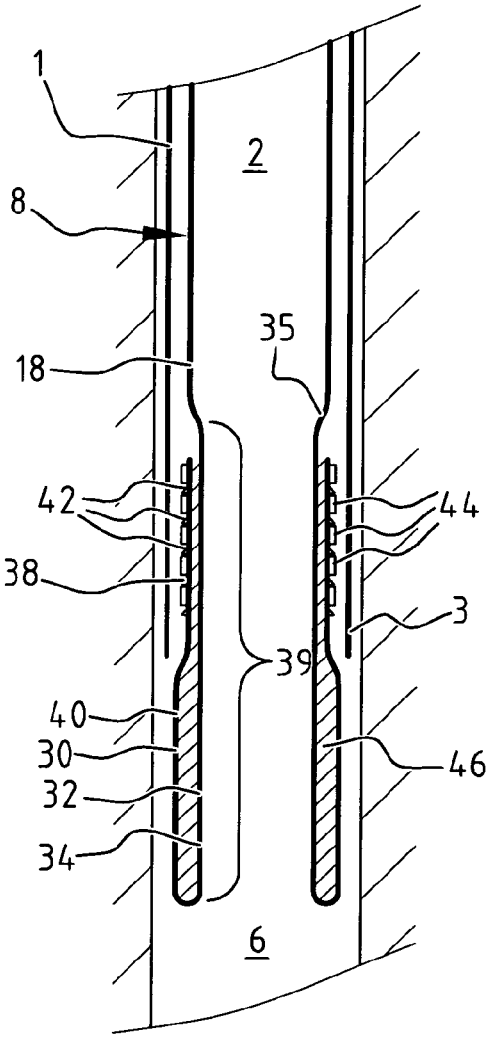
Figure 5:
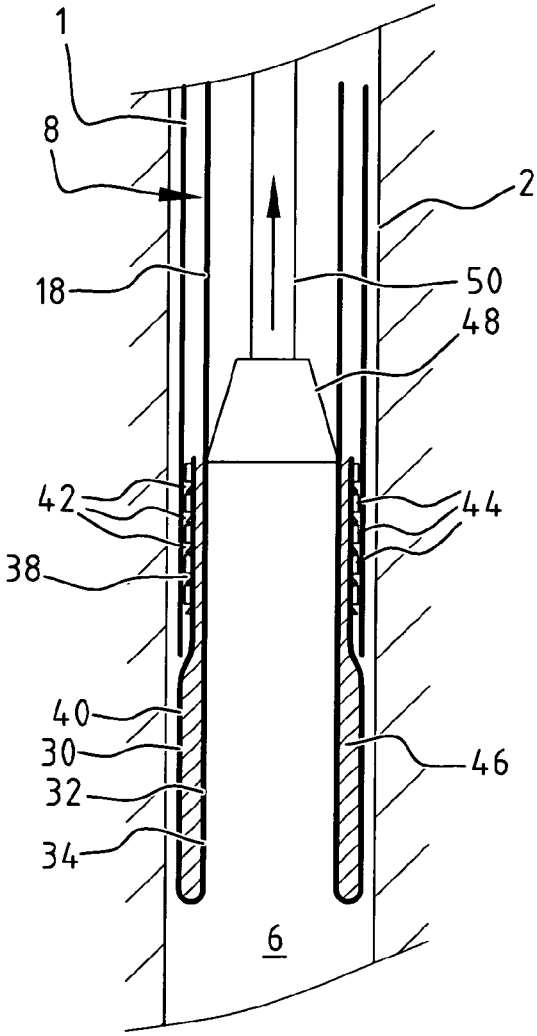
Figure 6:
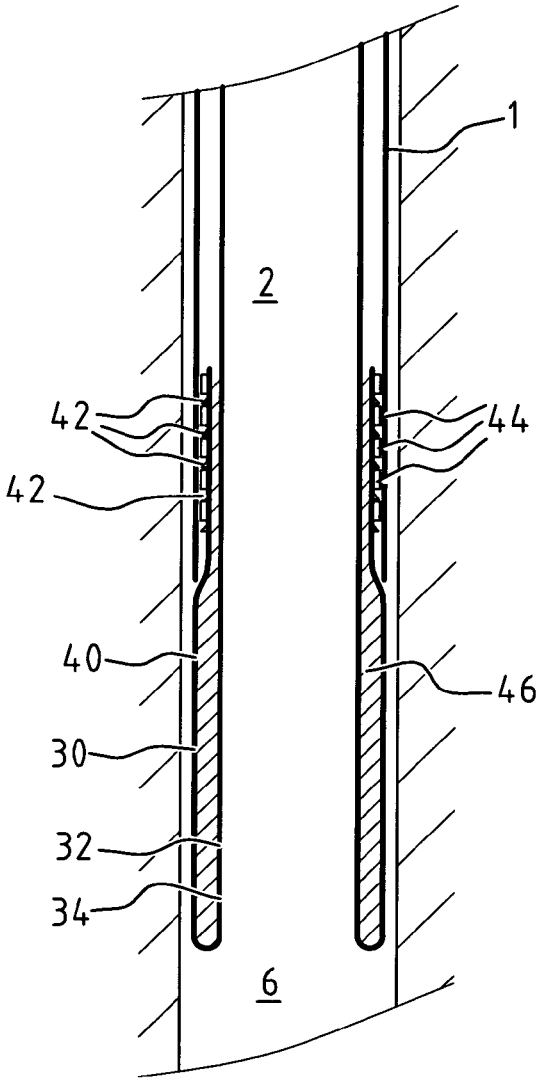
Figure 7:
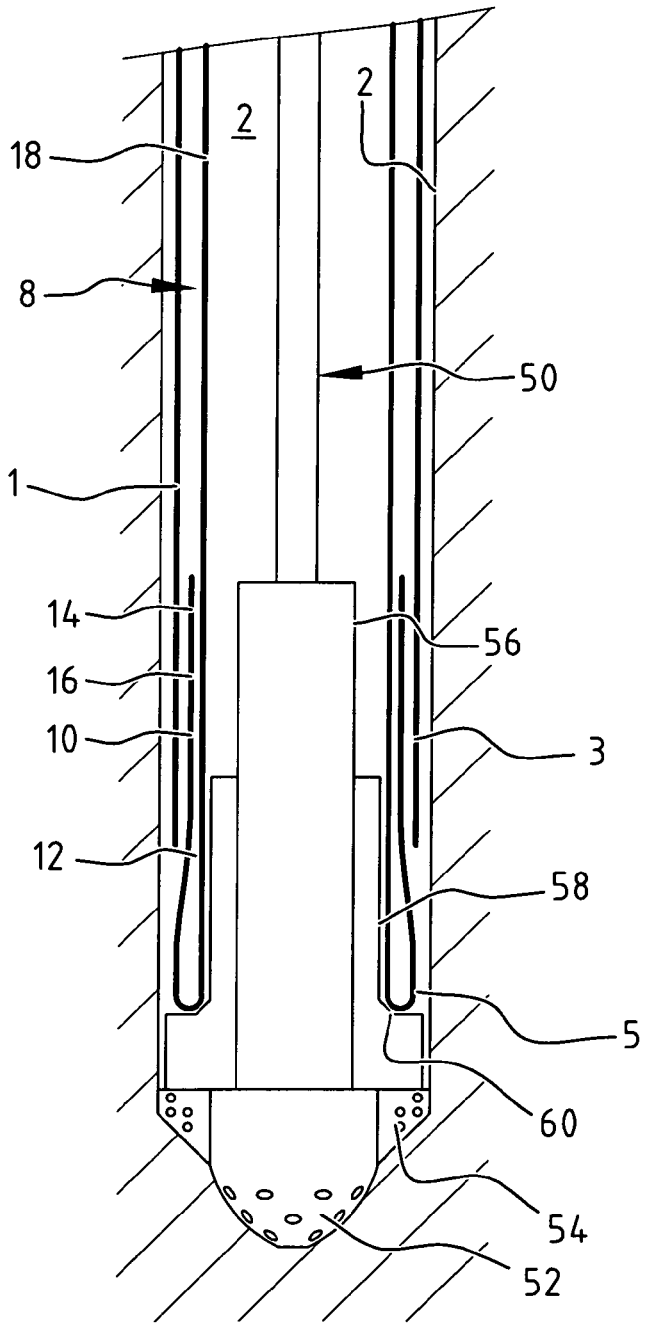

The invention will be described hereinafter in more detail and by way of example, with reference to the accompanying drawings in which:

FIG. 1 schematically shows an embodiment of the method of the invention during a first stage of expansion of a tubular element in a wellbore;

FIG. 2 schematically shows the tubular element of the embodiment of FIG. 1 during a second stage of expansion;

FIG. 3 schematically shows the tubular element of the embodiment of FIG. 1 during a third stage of expansion;

FIG. 4 schematically shows an alternative embodiment of the method of the invention during a first stage of expansion of a tubular element in a wellbore;

FIG. 5 schematically shows the tubular element of the alternative embodiment during a second stage of expansion;

FIG. 6 schematically shows the tubular element of the alternative embodiment during a third stage of expansion; and FIG. 7 schematically shows a preferred modification of the embodiment of FIGS. 1-3.

In the detailed description below, like reference numerals relate to like components.

FIG. 1 shows a tubular element 1, having a downhole end 3, extending into a wellbore 2 formed in an earth formation 4. The tubular element 1 is referred to hereinafter as the "previous tubular element 1". The previous tubular element 1 can be, for example, a casing that has been installed in the wellbore 2 in a conventional manner, or a tubular element that has been radially expanded, for instance using an expander. Also, the previous tubular element 1 can be a tubular element that has been radially expanded by eversion wherein the wall of the tubular element is progressively bent radially outward and in axially reverse direction.

The wellbore 2 has an open-hole section 6 below the previous tubular element 1. An expandable tubular element 8 extends into the previous tubular element 1. The tubular element 8 comprises an uphole section 18 and a downhole section 17. The uphole section 18 has an outer diameter which is smaller than an inner diameter of the previous tubular element 1. The uphole section 18 may be designed to be expanded to an expanded inner diameter which is substantially equal to the inner diameter of the previous tubular element 1. Alternatively, the uphole section 18 may be designed to be expanded to an expanded outer diameter which is substantially equal to the inner diameter of the wellbore 2. The diameter of the expanded uphole section may for instance be predetermined by one or more of: the outer diameter, the inner diameter, and the wall thickness of the uphole section 18. In the context of the present invention, the diametrical size means the predetermined size (outer diameter, inner diameter and/or wall thickness) to provide a certain (inner or outer) diameter after eversion of the pipe.

The downhole section 17 has an outer diameter which is smaller than the outer diameter of the uphole section 18. At its downhole end, the downhole section 17 extends radially outward and in axially reverse direction forming a start expanded tubular section 14 extending around the unexpanded part of the downhole section 17. The unexpanded part 19 of the downhole section 17 and the uphole section 18 together form the unexpanded section 12 of the tubular element 8. The start expanded tubular section 14 has an outer diameter which is smaller than the inner diameter of the previous tubular element 1. Together, the start expanded tubular section 14 and the unexpanded part 20 of the downhole section 17 form a start piece 19.

The start expanded tubular section 14, having expanded end 16, forms an initial length of expanded tubular section 10. The start expanded tubular section 14 has a (slightly) smaller outer diameter than the inner diameter of the previous tubular element 1 to allow the tubular element 8 to be lowered through the previous tubular element 1. The start expanded tubular section 14 may be provided with anchoring means (not shown) for anchoring the initial length 14 to the inner surface of the previous tubular element 1. The anchoring means may include, for example, (conventional) slips.

The unexpanded tubular section 12 has a downhole portion 17, which has a reduced diameter relative to an upper portion 18 of the unexpanded tubular section 12. The downhole portion 17 has a diametrical size (e.g. inner diameter, outer diameter and/or wall thickness) which causes the downhole portion to expand to an outer diameter which is substantially equal to the inner diameter of the previous tubular element 1. Herein, the downhole portion 17 is expanded by bending the wall of the downhole portion 17 radially outward and in axially reverse direction and by moving the unexpanded tubular section 12 axially downward relative to the initial length 14. The upper portion 18 of the unexpanded tubular section may have a diametrical size (e.g. inner diameter, outer diameter and/or wall thickness) which causes the upper portion to expand to an outer diameter substantially equal to the diameter of the wellbore 2 when the wall of the upper portion 18 is bent radially outward and in axially reverse direction by moving the unexpanded tubular section 12 axially downward relative to the initial length 14.

The start piece 19, including the reduced diameter section 17, is connected to the uphole section 18 at surface. In an embodiment, the reduced diameter section 17 is connected to the uphole section 18. In a second step, part of the reduced diameter section 17 is bend outward and everted to provide the start expanded tubular section 14.

Subsequently, the tubular element 8 is introduced in the wellbore 2 to arrange the start expanded tubular section 14 a short distance above the downhole end of the previous tubular element 1 (FIG. 1). Preferably, the transition 15 between the downhole portion 17 and the upper portion 18 is positioned such that the downhole portion 17 will expand within the previous tubular element 1 and that the upper portion 18 will expand below the previous tubular element 1 when the unexpanded tubular section 12 is moved axially downward.

FIG. 2 shows the tubular element 8 during expansion of the start piece 20. Herein, the remainder of the downhole portion 17 is everted. Everting the downhole portion 17 increases the length of the upper part 16 of the expanded tubular section 10. Said upper part 16 preferably engages the inner surface of the previous tubular element 1.

FIG. 3 shows the tubular element 8 after the entire downhole portion 17 of the unexpanded tubular section 12 has been expanded by eversion. The outer diameter of the expanded downhole portion 17 is substantially equal to the inner diameter of the previous tubular element 1. A part 13 of the upper portion 18 has been expanded by eversion to an outer diameter which is substantially equal to the diameter of the wellbore 2.

FIG. 4 shows the previous tubular element 1 in a wellbore 2. The wellbore 2 has an open-hole section 6 below the previous tubular element 1. An expandable tubular element 8 having an outer diameter which is smaller than the inner diameter of the previous tubular element 1, extends into the previous tubular element 1.

The downhole end of the tubular element 8 is provided with a start piece 39. The start piece 39 comprises a downhole portion 34 having a reduced outer diameter relative to an upper portion 18 of the tubular element 8. The downhole portion 34 extends at its downhole end radially outward and in axially reverse direction, forming a start expanded tubular section 30. The start expanded tubular section 30 extends around an unexpanded part 32 of the downhole portion 34. At transition 35 the diameter of tubular element changes from the diameter of the uphole section 8 to the smaller (inner or outer) diameter of the downhole section 34.

The start expanded tubular section 30 includes an upper part 38 of a first outer diameter and a lower part 40 of a second outer diameter. The second outer diameter is preferably greater than the first outer diameter. The upper part 38 may at its outer surface be provided with anchoring means 42 for anchoring the upper part to the inner surface of the previous tubular element 1. Also, annular seals 44 for sealing the upper part 38 relative to the previous tubular element 1 may be provided. The anchoring means 42 comprise, for example, teeth adapted to grip the inner surface of the previous tubular element 1.

A layer of filler material 46 may be arranged in an annular space between the expanded tubular section 30 and the downhole portion 34. The layer of filler material 46 may be adapted to transfer an expansion force between the downhole portion 34 and the expanded tubular section 30 during radial expansion of said downhole portion and expanded tubular section, as will be explained hereinafter. Alternatively, the filler material may provide lubrication for expansion and eversion.

Together, the downhole section 34, the lower part 40 and the upper part 38 of the expanded tubular section, the optional anchoring means 42, the optional annular seals 44, and the optional filler material 46 constitute the start piece 39.

The upper portion 18 has a diametrical size (e.g. inner diameter, outer diameter and/or wall thickness) causing the upper portion to expand to an outer diameter which is substantially equal to the diameter of the wellbore 2 when the wall of the upper portion 16 is bent radially outward and in axially reverse direction.

The start piece 39 can be connected to the uphole portion 18 at surface. Subsequently, the tubular element 8 is introduced in the wellbore 2. As shown in FIG. 4, the upper part 38 of the start piece 39 is preferably positioned within the downhole end 3 of the previous tubular element 1. The lower part 40 is preferably positioned below the downhole end 3 of the previous tubular element 1.

FIG. 5 shows a subsequent step, wherein the start piece 39 of the tubular element 8 is radially expanded. Herein, the start piece 39 is expanded including the downhole portion 34 and the expanded tubular section 30. The start piece is, for instance, expanded by means of a conical expander 48 that is pulled uphole through said downhole portion 34 using a pulling string 50. The expander 48 has an outer diameter about equal to the inner diameter of the upper section 18. Consequently, after expansion the inner diameter of the downhole section 34 is about equal to the inner diameter of the upper section 18.

In a next step, shown in FIG. 6, the upper section 18 of the tubular element 8 is radially expanded by eversion thereof. Herein, the unexpanded part 32 is pushed into the expanded part.

During normal operation of the embodiment of FIGS. 1-3, the tubular element 8 is at surface provided with the start piece 19. The reduced diameter section 17 is connected to the upper part 18, for instance by welding. Than, the start expanded tubular section 14 is bend outward and in axially reverse direction.

If the previous tubular element 1 has been radially expanded by eversion, wherein the downhole end 3 of the previous tubular element 1 may have been damaged due to a failure during the eversion process, the damaged portion of the previous tubular element 1 may be removed using, for instance, a cutting or milling tool prior to lowering the tubular element 8 through the previous tubular element 1.

Subsequently, the tubular element 8 including said start piece 19 is introduced through the previous tubular element 1 to the position shown in FIG. 1. The anchoring means provided to the start expanded tubular section 14 are then activated to anchor the initial length 14 to the inner surface of the previous tubular element 1.

In a next step (FIG. 2) the unexpanded tubular section 12 is moved axially downward relative to the initial length 14 by means of a force applied directly to the unexpanded tubular section 12 at surface and/or by the weight of the unexpanded tubular section 12. As a result the downhole portion 17 of the unexpanded tubular section 12 is radially expanded by progressive eversion so that the upper part 16 of the expanded tubular section 10 is gradually formed. Said upper part 16 preferably engages the inner surface of the previous tubular element.

In a subsequent step (FIG. 3), axial downhole movement of the unexpanded tubular section 12 is continued after said upper part 16 has been formed. Thus, the upper portion 18 of the unexpanded tubular section 12 is radially expanded by progressive eversion below the previous tubular element 1. The outer diameter of the expanded part 13 of the upper part 18 is substantially equal to the diameter of the wellbore 2. The expanded part 13 may engage the wellbore wall. Downward movement of the unexpanded tubular section 12 is continued until substantially the entire unexpanded tubular section 12, or a predetermined part thereof, has been radially expanded by eversion.

During normal operation of the alternative embodiment of FIGS. 4-6, the tubular element 8 is at surface provided with the start piece 39. Herein, the reduced diameter section 34 is connected to the upper part 18. Subsequently, the expanded tubular section 30, including the lower part 40 and the upper part 38 having a reduced outer diameter, is provided by bending the end of the reduced diameter section 34 radially outward and in reverse direction. The layer of filler material 46 is arranged in the annular space between the expanded section 30 and the non-expanded section of the reduced diameter part 34. The anchoring means 42 and/or the annular seals 44 may be provided to the outer surface of the upper part 38.

If the previous tubular element 1 has been formed by eversion wherein its downhole end is damaged due to a failure during the eversion process, the damaged portion of the previous tubular element 1 may be removed, for instance using a cutting or milling tool.

Subsequently, the tubular element 8, including the start piece 39, is introduced in the wellbore through the previous tubular element 1 to the position shown in FIG. 4.

In a subsequent step (FIG. 5), the start piece 39 is radially expanded. For instance, the expander 48 is pulled through the start piece 39 using pulling string 50 to radially expand the downhole portion 34 to substantially the same inner or outer diameter as the upper portion 18 of the unexpanded tubular section 32. The layer of filler material 46 transfers the expansion force to the expanded tubular section 30, which is thereby also radially expanded. The cross-sectional size of the expander 48, the inner and outer diameter of the upper part 38 of the expanded tubular section 30, and the thickness of the layer of filler material 46 may be selected such that the upper part 38 will be anchored to the previous tubular element 1 as a result of being expanded by the expander 48. The lower part 40 is preferably expanded to have an outer diameter substantially equal to the diameter of the wellbore 2. Afterwards, the expander 48 is removed from the wellbore 2.

In a subsequent step (FIG. 6), the unexpanded tubular section 32 is pushed axially downhole relative to the upper part 38 of the expanded tubular section 30 by means of a force directed downhole. Said force may be applied directly to the unexpanded tubular section 32 at surface and/or by the weight of the unexpanded tubular section 32. As a result the unexpanded tubular section 32 is radially expanded by progressive eversion so that the expanded tubular section 30 is extended in downhole direction until substantially the entire unexpanded tubular section 32, or a predetermined part thereof, has been radially expanded.

FIG. 7 shows a modification of the embodiment of FIGS. 1-3. Herein, the wellbore 2 is drilled while substantially simultaneously radial expanding the unexpanded tubular section 12 by eversion. A drill string 50 having a drill bit 52 at its downhole end is extended from surface through the interior of the unexpanded tubular section 12. The drill bit 52 is positioned a short distance below the lower end of the unexpanded tubular section 12. Said short distance herein may be in the order of 10 to 100 metres.

The drill bit is preferably provided with retractable reamer blades 54 allowing the drill bit 52 to be lowered through the unexpanded tubular section 12 with the reamer blades retracted, and to drill a further section of the wellbore 2 to a diameter equal to the previous wellbore section with the reamer blades 54 expanded. The drill string may include a downhole motor 56 for rotating the drill bit 52. Alternatively, the drill string including the drill bit may be rotated using a top drive at surface (not shown). The drill string may be provided with a support member 58 having a support shoulder 60 for supporting the curved downhole end of the unexpanded tubular section 12.

During use, the drill bit 52 may be rotated to further drill the wellbore 2 while the unexpanded tubular section 12 is substantially simultaneously moved downhole. The relatively short axial distance between the drill bit 52 and the downhole end 5 of the unexpanded tubular section 12 is kept substantially constant by engagement of said downhole end 5 and the support shoulder 60 of the support member 58. Thus the length of the open-hole section 6 can be minimized during drilling. Such short open hole section reduces the risk of undesired flow of formation fluid into the wellbore 2 or undesired outflow of drilling fluid into the earth formation. Undesired inflow of outflow can be detected at an early stage or accurately linked to a certain wellbore section. Due to the limited open hole section, it will be easier to control any undesired fluid flow due to the limited flow.

The embodiment shown in FIG. 7 is equally applicable to the embodiment of FIGS. 4-6, which can be modified in similar manner to drill the wellbore 2 using the drill string 50 while simultaneously radially expanding the tubular element 8 by eversion.

As mentioned above, the tubular element to be expanded can be anchored to the previous tubular element by means of slips. Such slips can be activated by, for example, a stream of fluid pumped between the tubular element and the previous tubular element so as to exert a pressure on a mandrel that activates the slips. In the embodiment of FIGS. 4-6, the layer of filler material 46 suitably remains at its position relative to the expanded tubular section after the expander has been pulled through the downhole portion of the unexpanded tubular section. This may be achieved, for example, by an adhesive between the layer of filler material 46 and the expanded tubular section, or alternatively by friction forces.

Alternatively the layer of filler material 46 moves downward together with the eversion zone, that is, the zone where the wall of the unexpanded tubular section bends radially outward and in axially reverse direction during the eversion process. Such downward movement of the layer of filler material 46 can be achieved by applying a friction sleeve around the unexpanded tubular section, and above the layer of filler material. The friction sleeve remains temporarily stationary relative to the unexpanded tubular section by friction, however the sleeve is forced to slide along the unexpanded tubular section once the friction forces are exceeded by a selected external force. During the eversion process, the unexpanded tubular section moves downward at twice the speed of the eversion zone, therefore the friction sleeve forces the layer of filler material to move downward together with the eversion zone, whereby the friction sleeve is forced to slide upwardly relative to the unexpanded tubular section. Instead of applying the friction sleeve above the layer of filler material, the friction sleeve can be integrally formed with the layer of filler material.

The description above describes exemplary embodiments of the present invention for the purpose of illustration and explanation. It will be apparent that many modifications and changes to the exemplary embodiments set forth above are possible without departing from the scope of the invention. It is noted that the features described above may be combined, each individually or in any combination of features, with one or more of the features of the claims.

The invention claimed is:

1. A method of radially expanding a tubular element below a previously installed tubular element arranged in a wellbore, including the steps of:

connecting a downhole section to an uphole section of the tubular element, the downhole section having a smaller diameter than the uphole section;

bending a downhole end of the downhole section radially outward and in axially reverse direction to form an expanded tubular section of the downhole section extending around an unexpanded part of the downhole section;

arranging said expanded tubular section at least partially within a downhole end of the previously installed tubular element;

anchoring said expanded tubular section to the previously installed tubular element;

increasing the length of an expanded tubular section of the tubular element by pushing an unexpanded tubular section downhole relative to said expanded tubular section to expand the unexpanded tubular section by bending the wall of the unexpanded tubular section radially outward and in axially reverse direction; and inserting a layer of filler material in an annular space between the expanded tubular section and the unexpanded part of the downhole section, wherein an adhesive is located between the layer of filler material and the expanded tubular section.

2. The method of claim 1, wherein said diameter includes one or both of outer diameter and inner diameter.

3. The method of claim 1, wherein the uphole section has a selected outer diameter causing the uphole section to expand to an expanded outer diameter which is larger than an outer diameter of the expanded tubular section.

4. The method of claim 3, wherein the expanded outer diameter is substantially equal to an outer diameter of the previously installed tubular element.

5. The method of claim 3, wherein the expanded outer diameter is substantially equal to a diameter of the wellbore.

6. The method of claim 3, wherein the outer diameter of said expanded tubular section is smaller than an inner diameter of the previously installed tubular element.

7. The method of claim 1, wherein the expanded tubular section is provided with anchoring means for anchoring said expanded tubular section to the inner surface of the previously installed tubular element.

8. The method of claim 1, further comprising providing the expanded tubular section with sealing means for sealing said expanded tubular section relative to the previously installed tubular element.

9. The method of claim 1, wherein the expanded tubular section includes an upper part and a lower part, the upper part having an upper outer diameter which is smaller than a lower outer diameter of the lower part, the method including the step of:

radially expanding said downhole section to radially expand said upper part against an inner surface of the previously installed tubular element.

10. The method of claim 9, wherein the step of radially expanding includes pulling an expander through the downhole section.

11. The method of claim 1, wherein the layer of filler material is adapted to transfer an expansion force between the unexpanded part of the downhole section and the expanded tubular section.

12. The method of claim 1, wherein pushing the unexpanded tubular section downhole includes the application of a force to an uphole end of the unexpanded tubular section in the direction of the downhole end of the tubular element.

13. A system for radially expanding a tubular element below a previously installed tubular element arranged in a wellbore, comprising:

a tubular element including a downhole section connected to an uphole section, the downhole section having a smaller diameter than the uphole section;

an expanded tubular section, which is bent radially outward and in axially reverse direction, extending around an unexpanded part of the downhole section;

a layer of filler material in an annular space between the expanded tubular section and the unexpanded part of the downhole section, wherein an adhesive is located between the layer of filler material and the expanded tubular section; and anchoring means provided on an outside surface of said expanded tubular section for anchoring the tubular element to the previously installed tubular element.

* * * * *